US009010603B2

(12) United States Patent
Schnabel et al.

(10) Patent No.: US 9,010,603 B2
(45) Date of Patent: Apr. 21, 2015

(54) METHOD FOR WEB TENSION SETTING

(75) Inventors: Holger Schnabel, Veitshoechheim (DE); Stephan Schultze, Lohr-Wombach (DE); Mario Goeb, Wuerzburg (DE)

(73) Assignee: Robert Bosch GmbH, Stuttgart (DE)

( * ) Notice: Subject to any disclaimer, the term of this patent is extended or adjusted under 35 U.S.C. 154(b) by 593 days.

(21) Appl. No.: 13/342,950

(22) Filed: Jan. 3, 2012

(65) Prior Publication Data

US 2012/0211581 A1 Aug. 23, 2012

(30) Foreign Application Priority Data

Jan. 4, 2011 (DE) ..... 10 2011 007 989
Mar. 16, 2011 (DE) ..... 10 2011 014 074

(51) Int. Cl.
*B65H 23/188* (2006.01)
*B65H 23/192* (2006.01)
*G03G 15/00* (2006.01)

(52) U.S. Cl.
CPC ..... *B65H 23/192* (2013.01); *B65H 2557/24* (2013.01); *B65H 2801/21* (2013.01); *G03G 15/6517* (2013.01); *G03G 2215/00455* (2013.01)

(58) Field of Classification Search
CPC .. B65H 23/18; B65H 23/188; B65H 23/1888; B41F 13/02
USPC ..... 226/4
See application file for complete search history.

(56) References Cited

U.S. PATENT DOCUMENTS 7,185,587 B2 * 3/2007 Brandenburg et al. ..... 101/484
7,204,189 B2 * 4/2007 Brandenburg et al. ..... 101/485
7,559,279 B2 * 7/2009 Brandenburg et al. ..... 101/485
2010/0280644 A1 * 11/2010 Schnabel et al. ..... 700/103

FOREIGN PATENT DOCUMENTS

DE 10 2008 056 132 A1 5/2010
DE 10 2009 016 206 A1 10/2010

* cited by examiner

*Primary Examiner* — William E Dondero
(74) *Attorney, Agent, or Firm* — Maginot, Moore & Beck LLP

(57) ABSTRACT

A method is disclosed for web tension setting in a processing machine for processing a material web, in particular a shaftless printing press. In order to set the web tension in a first web tension section with a length L which is delimited upstream by a first clamping point and downstream by a second clamping point, the first clamping point is loaded with a first manipulated variable which is produced using a first element with a first transfer function $G_1(s)$ (G3), and the second clamping point is loaded with a second manipulated variable which is produced using a second element with a second transfer function $G_2(s)$ (G4), wherein $c_1G_1(s)=-c_2G_2(s)$. Thus, it is possible to keep the speed constant even during the regulation at a fixed or variable point x within the web tension section, wherein $x=|c_1/(c_1+c_2)|L$ lies behind the first clamping point.

13 Claims, 1 Drawing Sheet

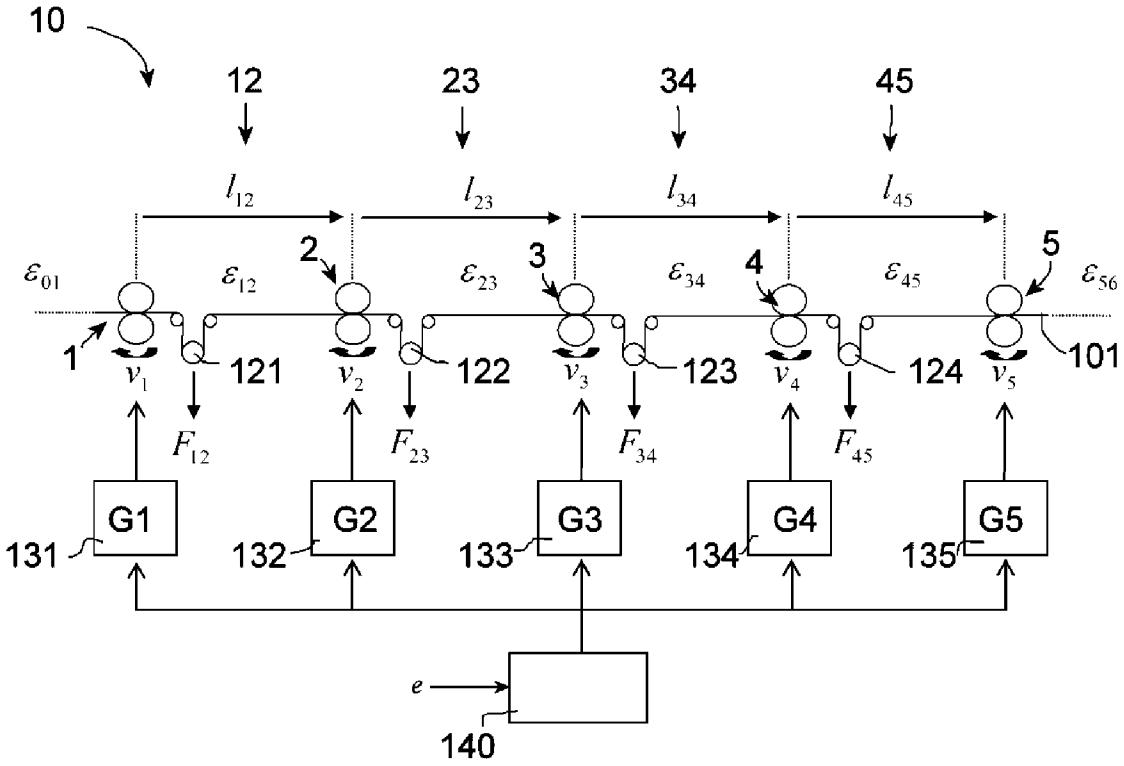
10
12
23
34
45
$l_{12}$
$l_{23}$
$l_{34}$
$l_{45}$
$\varepsilon_{01}$
$\varepsilon_{12}$
$\varepsilon_{23}$
$\varepsilon_{34}$
$\varepsilon_{45}$
$\varepsilon_{56}$
1
2
3
4
5
$v_1$
$v_2$
$v_3$
$v_4$
$v_5$
$F_{12}$
$F_{23}$
$F_{34}$
$F_{45}$
121
122
123
124
101
G1
G2
G3
G4
G5
131
132
133
134
135
e
140

METHOD FOR WEB TENSION SETTING

This application claims priority under 35 U.S.C. §119 to both (i) patent application no. DE 10 2011 007 989.0, filed on Jan. 4, 2011 in Germany, and (ii) patent application no. DE 10 2011 014 074.3, filed on Mar. 16, 2011 in Germany. The disclosures of the above-identified patent applications are both incorporated herein by reference in their entirety.

The present disclosure relates to a method for web tension setting in a processing machine.

Although the disclosure will be described in the following text substantially with reference to printing presses, it is not restricted to an application of this type, but rather can be used in all types of processing machines, in which the tension of a material web is to be determined. The material web can be formed from paper, fabric, cardboard, plastic, metal, rubber, in film form, etc.

BACKGROUND

In processing machines, in particular printing presses, a material web is moved along driven axles (web transport axles), such as pull rolls or advancing rolls, and non-driven axles, such as deflection, guiding, drying or cooling rolls. At the same time, the material web is processed, for example printed, punched, cut, folded, etc., by means of usually likewise drive processing axles.

The web tension of the material web is influenced, for example, via what are known as clamping points which clamp the material web positively or non-positively. There are as a rule driven transport or processing units. In a gravure printing press, a clamping point is usually formed by a printing unit, in which a frictional unit exists between the driven impression cylinder, the impression roller and the material web. The material web is divided into web tension sections, a web tension section being delimited by two clamping points. Further driven and/or non-driven axles can be arranged within a web tension section. The entire material web is often divided into a plurality of web tension sections, sometimes also with different web tension setpoint values. A web tension regulating means is usually used to maintain the setpoint values.

The adjustment or regulation of the web tension of a web tension section can take place by way of different methods. Downstream means that the clamping point which delimits the downstream end of the web tension section is adjusted, and upstream means that the clamping point which delimits the upstream end of the web tension section is adjusted. In this simple embodiment, however, the web tension in leading and/or trailing web tension sections is not decoupled from the actuating movement. Rather, the change in the web tension is transported through the machine such that it follows the material web course, and is to be adjusted in all following sections. In addition to this indirect disruption on account of the transport of the material web, a direct disruption on account of the actuating movement is to be found in the web section which adjoins the adjusted clamping point.

It is possible, in the case of a downstream regulation by means of a (dynamic) downstream pilot control, to pilot control all the following clamping points in such a way that they directly compensate for the effects of the leading clamping point. As a consequence, this ensures that all the following web tension regulators do not have to adjust the disruptions of the actuating movement and of the coupling by the material web.

DE 10 2008 056 132 A1 proposes decoupling for an upstream regulation, a (dynamic) downstream pilot control by means of PT1 element also being carried out in addition to a (constant) upstream pilot control.

DE 10 2009 016 206 A1 discloses a method with decoupling which is implemented exclusively in the upstream direction. Here, a combination of pilot control weighted in the upstream direction by a $DT_1$ element and pilot control weighted by a negative $PT_1$ element exclusively of the rear delimiting clamping point is disclosed. The specifications "upstream of" and "downstream of" a clamping point or material web section relate to the transport direction of the material web, that is to say the material web course.

All known decoupling strategies have the disadvantage that the web running speed changes within the web sections. Since, however, for example in digital printing, the print heads are sited within a web section and not directly at a clamping point, every actuating movement during the regulation of the web tensile force leads as a rule to a change in the material web speed and therefore to a register error.

It is therefore desirable to specify a method for web tension setting in a processing machine, in which method the material web speed can be kept constant or can be changed in a targeted manner during the decoupling at any desired point within a web tension section.

SUMMARY

According to the disclosure, a method for web tension setting in a processing machine having the features of set forth below is proposed. Advantageous refinements are the subject matter of the following description.

Features of the disclosure substantially use the finding that the material web speed can be predefined in a targeted manner (for example, can be kept constant or can be changed in a targeted manner) during a web tension regulation at any desired point within a web tension section with a length L which is delimited upstream by a first clamping point and downstream by a second clamping point, if the manipulated variable which is output by the regulation is applied in a defined way to both clamping points. To this end, the manipulated variable is controlled in each case via an element, the transfer function of one of the elements being the negative of the transfer function of the other of the elements. The point within the web tension section, at which point the material web speed is predefined, is set via prefactors of the elements. In this context, the length L is divided proportionately to the prefactors. The disclosure provides the option of predefining the material web speed in a targeted manner at any desired point within the web tension section during a web tension regulation. If the elements are time-dependent, the location of a point of constant speed can be varied; if the elements are constant, this is also the point of constant material web speed.

Moreover, features of the disclosure can be implemented particularly simply in practice. In particular, it can be superimposed on regulating structures, as are known in the prior art and have been described in the introduction. In the context of this disclosure, reference is made expressly here to the regulating structures according to DE 10 2008 056 132 A1 and DE 10 2009 016 206 A1. The combination of the present disclosure with these regulating structures is expressly stated to be a particularly preferred embodiment of the disclosure. As a result, decoupling of further sections can take place.

Starting from an existing regulating structure, a regulating structure according to the disclosure can be obtained by simple mathematic combination (for example, by addition, subtraction, multiplication or division) with a static or dynamic element, so that, as a result, the elements for the clamping points of the material web section of interest meet the conditions according to the disclosure. A dynamic element has a non-constant transfer function. A non-constant transfer function is every transfer function which does not have the form G(s)=k, but which instead exhibits a dependence on s. For example, a D element, I element, PI element, PID element, PT1 element, DT1 element, PTn element, DTn element in each case have a non-constant transfer function, whereas a P element has a constant transfer function. Elements with a non-constant transfer function are called dynamic elements in this application, whereas elements with a constant transfer function are called static elements.

A computing unit according to the disclosure, for example a control unit of a printing press, is set up, in particular in terms of programming technology, for carrying out a method according to the disclosure.

The implementation of features of the disclosure in the form of software is also advantageous, since this makes particularly low costs possible, in particular if a computing unit which carried it out is also used for further tasks and is therefore present in any case. Suitable data storage media for providing the computer program are, in particular, diskettes, hard disks, flash memories, EEPROMs, CD-ROMs, DVDs, inter alia. A download of a program via computer networks (Internet, Intranet, etc.) is also possible.

Further advantages and refinements of the disclosure result from the description and the appended drawing.

It goes without saying that the features which are stated above and are still to be explained in the following text can be used not only in the respectively specified combination, but also in other combinations or on their own, without departing from the scope of the present disclosure.

Features of the disclosure are shown diagrammatically in the drawing using exemplary embodiments and will be described in detail in the following text with reference to the drawing.

BRIEF DESCRIPTION OF THE DRAWING

FIG. 1 shows a diagrammatic illustration of a generalized regulating structure for the decoupled regulation of the web tension for a web tension section.

DETAILED DESCRIPTION

In FIG. 1, a generalized regulating structure for the decoupled regulation of the web tension for a web tension section in a printing press is described. A diagrammatic detail of a printing press 10 is shown, in which printing press 10 a material web 101 is transported through five clamping points configured here as printing units 1 to 5 and is processed. A web tension section is formed between in each case two adjacent clamping points. For example, a web tension section 12 is delimited by the printing units 1 and 2, a web tension section 23 is delimited by the printing units 2 and 3, a web tension section 34 is delimited by the printing units 3 and 4, and a web tension section 45 is delimited by the printing units 4 and 5. Furthermore, the printing press has web tension sensors which are configured here as load cells 121 to 124 for determining the web tension or the tensile force in the respective web tension sections. The determination of the respective web tensions can also take place via other methods than by measurement; for example, DE 10 2005 058 810 A1 has published an alternative method. In the illustration shown, the web tension is set by influencing the circumferential speeds $v_1$ to $v_5$ of the printing units 1 to 5. In principle, the web tension can be set by means of angular adjustment, speed switching and/or limiting of the drive moment of at least one clamping point which delimits this web tension section.

The physical parameters, namely the length l, the elongation $\epsilon$ and the web tension or tensile force F of the individual web tension sections are likewise specified with corresponding indices in the FIGURE.

In order to regulate the web tension, a regulating deviation e is fed to a regulating element 140, for example a PI regulator, which calculates a manipulated variable from this. Said manipulated variable acts via individual elements 131 to 135 with associated transfer functions G1 to G5 on the circumferential speeds $v_1$ to $v_5$. The elements 131 to 135 can be zero elements (that is to say, G=0), but also P elements, I elements, D elements, $PT_1$ elements, $PT_2$ elements, $PT_n$ elements, DT elements, $DT_2$ elements, $DT_n$ elements, etc., with the known associated transfer functions. The elements 131 to 135 and 140 are expediently implemented in a computing unit.

In the following text, fundamental examples for a regulation of the web tension in the section 34 are to be described. The regulating deviation e is determined in this case from a comparison of the actual value $F_{34}$ with a setpoint value. The following regulating and decoupling strategies are known:

(1) Upstream regulation: G1=0, G2=0, G3=1, G4=0, G5=0

(2) Downstream regulation: G1=0, G2=0, G3=0, G4=1, G5=0

(3) Upstream regulation with upstream decoupling: G1=1, G2=1, G3=1, G4=0, G5=0

(4) Upstream regulation with upstream and downstream decoupling: G1=1, G2=1, G3=1, G4=0, G5=PT1

(5) Downstream regulation with downstream decoupling: G1=0, G2=0, G3=0, G4=1, G5=DT1

In these regulating strategies, it is not possible to keep the material web speed constant at any desired point in the section 34. Rather, either the speed $v_3$ or the speed $v_4$ remains constant.

In order to achieve this aim, in the context of the disclosure, the two participating elements, G3 and G4 to keep the above example, are then selected in such a way that it holds that:

$$c_1G3=-c_2G4$$

The respective signs result from the regulating direction. An increase in the speed $v_3$ of the front clamping point 3 brings about a reduction in the web tensile force and, conversely, an increase in the speed $v_4$ of the rear clamping point 4 brings about a rise in the web tensile force. The point of constant speed can be influenced via a weighted combination of increase and decrease in the speeds $v_3$ and $v_4$, the ratio $c_1/(c_1+c_2)$ defining the point x downstream of the clamping point 3, at which point the speed remains constant, in accordance with $x=|c_1/(c_1+c_2)|l_{34}$.

$|c_1+c_2|=1$ is expediently standardized, with the result that it then holds that: $x=|c_1|l_{34}$.

The disclosure makes the targeted stipulation of the material web speed possible. If the elements $c_1$ and $c_2$ are not time-dependent, the material web speed at the point x is constant. Stipulation of time-dependent elements $c_1$ and $c_2$, that is to say $c_1(t)$ and $c_2(t)$, can achieve a situation where the point x of constant material web speed migrates through the web tension section and/or a targeted change in the material web speed is achieved at the original point x.

For example, G3=½ and G4=−½ can be selected, x then lying precisely in the middle between 3 and 4. The signs then indicate a negative regulating direction, that is to say the web tension drops in the case of a positive manipulated variable.

The known decoupling strategies can be maintained in a simple way, that is to say the web tension regulation of one section continues not to have an effect on other sections, if G3=½ and G4=−½ can be obtained starting from the known formula by combination (for example, addition, subtraction, multiplication or division) of an element. For example, the above-described upstream regulation with upstream and downstream decoupling (4) (G1=1, G2=1, G3=1, G4=0, G5=PT1) can be altered according to the disclosure in a simple way by an element G=½ being subtracted. A preferred upstream regulation with upstream and downstream decoupling with a constant speed in the middle between 3 and 4 is then obtained according to:

$$G1=½,\ G2=½,\ G3=½,\ G4=-½,\ G5=PT1-½.$$

If it is intended that the point x of constant speed lies $0.9\,l_{34}$ behind 3, G3=0.9 and G4=−0.1 are to be selected. This results, for example, from (4) by subtraction of G=0.1 to give:

$$G1=0.9,\ G2=0.9,\ G3=0.9,\ G4=-0.1,\ G5=PT1-0.1.$$

By subtraction of G=½ and subsequent multiplication with G=−1, the following is obtained from the downstream regulation with downstream decoupling (5) (G1=0, G2=0, G3=0, G4=1, G5=DT1):

$$G1=½,\ G2=½,\ G3=½,\ G4=-½,\ G5=½-DT1.$$

It is to be noted that the web tension section to be regulated does not also have to be that web tension section, in which a constant speed is desired. For example, the following is known from DE 10 2009 016 206 A1: G1=DT1, G2=DT1, G3=DT1, G4=−PT1, G5=0. The following is obtained from this by addition of G=½ PT1:

$$G1=DT1+½PT1,\ G2=DT1+½PT1,\ G3=DT1+½PT1,\ G4=-½PT1,\ G5=½PT1,$$

with the result that the point of constant speed then lies in the middle between 4 and 5.

The disclosure affords the advantage that all the material web sections can be regulated in a decoupled manner via a differential regulation, that is to say simultaneous regulation of both clamping points, in combination with a modified pilot control of the clamping points, and at the same time the material web speed at any desired position of the system (for example, digital print head) does not depend on the regulation and decoupling. Here, depending on the selected regulating methods of the individual web sections (upstream, downstream or differential regulation) and the part section dynamics, the pilot control operations of the clamping points are carried out in a weighted or unweighted manner and dynamically with the corresponding section time constants or statically. The dynamic pilot control operations of all clamping points can take place with one or more combined dynamic time elements. These can be P elements, I elements, D elements, $PT_1$ elements, $PT_2$ elements, $PT_n$ elements, DT elements, $DT_2$ elements, $DT_n$ elements, . . . elements and dead times. One or more clamping points can be loaded with this dynamic decoupling. The pilot control operations can likewise also be weighted statically here.

The infeed unit and unwinding unit can likewise be incorporated into the pilot control in the upstream direction; the outfeed unit and winding unit can likewise be incorporated into the pilot control in the downstream direction.

These decoupling strategies which are shown in the disclosure apply to the regulation of the force, web tension and elongation. The actual force, actual web tension and/or actual elongation can therefore likewise be used as input variables for the regulation. Furthermore, a regulation and/or pilot control by way of variables reconstructed by means of observers would be conceivable.

Furthermore, the control variables of the elements 131 to 135 which act on the speeds $v_1$ to $v_5$ can be combined with control variables of web tension regulation operations of further web sections. In the above description, a regulation with measurement in web section 34 was described. If, in addition, there are also further web tension regulation operations, for example with measurement in the web sections 12, 23 and 45, their control variables are added to the speeds $v_1$ to $v_5$.

What is claimed is:

1. A method for setting web tension in a web tension section of a processing machine for processing a material web, the web tension section having a length L and being delimited upstream by a first clamping point and downstream by a second clamping point, the method comprising:

actuating the first clamping point based on a first manipulated variable which is produced using a first element with a first transfer function $G_1(s)$, and actuating the second clamping point based on a second manipulated variable which is produced using a second element with a second transfer function $G_2(s)$, wherein $c_1G_1(s)=-c_2G_2(s)$, and wherein a point x within the web tension section, at which the speed is kept constant, lies a length $x=|c_1/(c_1+c_2)|L$ from the first clamping point.

2. The method according to claim 1, wherein $|c_1+c_2|=1$.

3. The method according to claim 1, wherein the first element and the second element are obtained by mathematic combination of a regulating structure with a static or dynamic element.

4. The method according to claim 1, wherein the first manipulated variable is produced using the first element and the second manipulated variable is produced using the second element from one and the same regulator output variable.

5. The method according to claim 4, wherein at least one third clamping point which is situated upstream of the first clamping point in the material web course is loaded with a third manipulated variable which is also produced from the regulator output variable using a third element.

6. The method according to claim 5, wherein the third element also is obtained by mathematic combination of the regulating structure with the static or dynamic element.

7. The method according to claim 4, wherein at least one fourth clamping point which is situated downstream of the second clamping point in the material web course is loaded with a fourth manipulated variable which is also produced from the regulator output variable using a fourth element.

8. The method according to claim 7, wherein the fourth element is obtained by mathematic combination of the regulating structure with the static or dynamic element.

9. The method according to claim 1, wherein the first element and the second element are each a proportional element.

10. The method according to claim 1, wherein $c_1$ and $c_2$ are time-independent, with the result that x is also time-independent.

11. The method according to claim 1, wherein $c_1$ and $c_2$ in each case are time-dependent, with the result that x is also time-dependent.

12. The method according to claim 1, wherein the processing machine is a shaftless printing press.

13. A computing unit comprising:

a non-transitory computer readable medium storing programmed instructions; and a processor configured to execute the programmed instructions, wherein the programmed instructions are configured to cause the processor to carry out a method for setting web tension in a web tension section of a processing machine for processing a material web, the web tension section having a length L and being delimited upstream by a first clamping point and downstream by a second clamping point, the method comprising:

actuating the first clamping point based on a first manipulated variable which is produced using a first element with a first transfer function $G_1(s)$, and actuating the second clamping point based on a second manipulated variable which is produced using a second element with a second transfer function $G_2(s)$, wherein $c_1G_1(s)=-c_2G_2(s)$, and wherein a point x within the web tension section, at which the speed is kept constant, lies a length $x=|c_1/(c_1+c_2)|L$ from the first clamping point.

* * * * *